United States Patent [19]

Shelton

[11] 4,343,344

[45] Aug. 10, 1982

[54] TIE BACK HOLDER WITH PLEAT SUPPORT

[76] Inventor: Andrew B. Shelton, 2783 Ben Hill Rd., East Point, Ga. 30344

[21] Appl. No.: 100,740

[22] Filed: Dec. 6, 1979

[51] Int. Cl.[3] ..... A47H 1/00

[52] U.S. Cl. ..... 160/349 D; 248/200

[58] Field of Search ..... 160/349 R, 349 D, 348, 160/352; 2/215; 248/200, 201; 24/81 DS

[56] References Cited

U.S. PATENT DOCUMENTS

| | | | |
|---|---|---|---|
| 1,882,527 | 10/1932 | Stanley | 24/81 |
| 2,251,512 | 8/1941 | Bush et al. | 248/201 |
| 2,301,631 | 11/1942 | Lemieux | 160/349 |
| 3,203,469 | 8/1965 | Falkenberg | 160/348 |

FOREIGN PATENT DOCUMENTS

| | | | |
|---|---|---|---|
| 327141 | 10/1920 | Fed. Rep. of Germany | 160/349 |

*Primary Examiner*—C. J. Husar
*Assistant Examiner*—Cherney S. Lieberman
*Attorney, Agent, or Firm*—James B. Middleton

[57] ABSTRACT

A drapery tie back holder is disclosed. The tie back holder includes a base that can be attached to a wall or other surface by a single screw, and one arm extends beneath a drapery to hold one end of a tie back, and another arm extends from the base outside the drapery to hold the other end of a tie back. A stanchion may be provided extending from the base and mounting a pleat holder to support the last pleat in the drapery to prevent crushing of the pleats by the tie back. The pleat holder is cylindrical, and preferably malleable to be bent to the precise shape desired.

7 Claims, 5 Drawing Figures

TIE BACK HOLDER WITH PLEAT SUPPORT

Field of the Invention

This invention relates generally to drapery installation apparatus, and is more particularly concerned with tie back fastening means having pleat support means to prevent crushing of the pleats of the drapery.

BACKGROUND OF THE INVENTION

In conventional installations of draperies for windows, or otherwise for decoration, the draperies are pleated and hung from a curtain rod. Most commonly, the draperies are spaced from the wall from which the draperies are hung, the edge of the drapery then turning inwardly towards the wall to abut the wall. When tie backs are used, the tie back has most often been attached to a hook or the like, the tie back extends around the drapery to pull the pleats towards the hook, or the edge of the drapery, then the opposite end of the tie back is engaged with the same hook, or one located adjacent to the first hook. Since both ends of the tie back are placed substantially together at the surface of the wall, it will be understood that the tie back, being substantially homogeneous throughout its length, tends to flatten the pleats of the drapery and do away with the shape of the drapery as determined by the curtain rod.

Previous efforts to hold the drapery in the desired configuration have included rigid corner members for holding the tie back off the drapery itself so that the drapery will continue to hang in the desired folds. Other efforts have included spacer means placed beneath the drapery for spacing the drapery as desired in the area of the tie backs so the tie backs cannot crush the pleats and destroy the shape of the drapery. The externally disposed support members have been found to be troublesome, in addition to the fact that they usually detract from the desired design motif. The hidden supports have achieved some considerable popularity in use, but the prior art supports concentrate on the supporting of the drapery pleat and do not adequately provide for the attachment of the tie back. The tie back attaching means in the prior art supports generally include only one or more holes in the support to receive a conventional drapery hook. Thus, the prior art devices have generally required the user to provide his own solutions to the problem of attaching the tie backs, the spacer device solving only the problem of crushing the drapery pleats. Also, the prior art devices have usually been formed of rigid material allowing no individual shaping .

SUMMARY OF THE INVENTION

The present invention overcomes the above mentioned and other difficulties with the prior art by providing a first holding means disposable beneath the edge of a drapery for receiving the inner end of a tie back, and a second holding means extending in a plane parallel to the edge of the drapery for holding the opposite end of the tie back. Located between the first holding means and the second holding means, there is a pleat support for preventing the crushing of the last pleat in a drapery. It is a further feature of the present invention that the pleat support is somewhat resilient, and is adjustably locatable to coincide with the natural location of the final pleat. Additionally, the entire device of the present invention is easily installable with a single fastening means.

BRIEF DESCRIPTION OF THE DRAWINGS

These and other features and advantages of the present invention will become apparent from consideration of the following specification when taken in conjunction with the accompanying drawings in which.

DESCRIPTION OF THE PREFERRED EMBODIMENT

Figure 1:
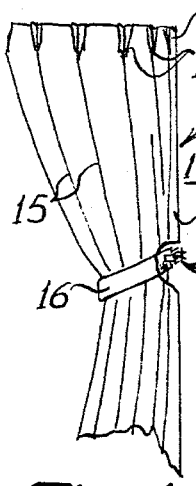
FIG. 1 is an elevational view showing a conventional drapery, the drapery and tie back being partially broken away to show the location of the tie back holder of the present invention.

Referring now more particularly to the drawings, and to that embodiment of the invention here chosen by way of illustration, it will be seen in FIG. 1 that the drapery 10 is mounted against a wall or other surface 11, the upper end 12 of the drapery 10 having a plurality of pleats 14 fixed therein. The pleats 14 determine the configuration of the drapery 10 as the drapery hangs, so that the pleats 14 are reflected in folds, or pleats 15, extending down the main panel of the drapery 10.

Ideally, these pleats 15 should be retained uniformly, even as the drapery 10 is pulled back by the tie back 16 so that the pleats 15 are gathered. To accomplish this, the tie back 16 must be held out from the wall 11 the same distance as the final pleat 18, so that the pleats 15 and 18 will not be crushed by the tie back 16 as the front portion of the tie back 16 passes over the drapery 10 and runs back to the wall 11. It will thus be seen in FIG. 1 of the drawings that the tie back holder 20 is attached to the wall 11 in the vicinity of the pleat 18, behind the drapery 10.

Figure 2:
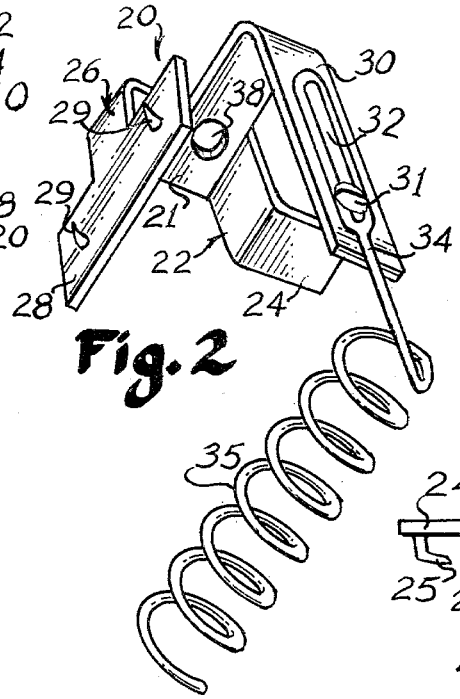
FIG. 2 is a perspective view of a tie back holder made in accordance with the present invention as shown in FIG. 1 of the drawings.
Figure 3:
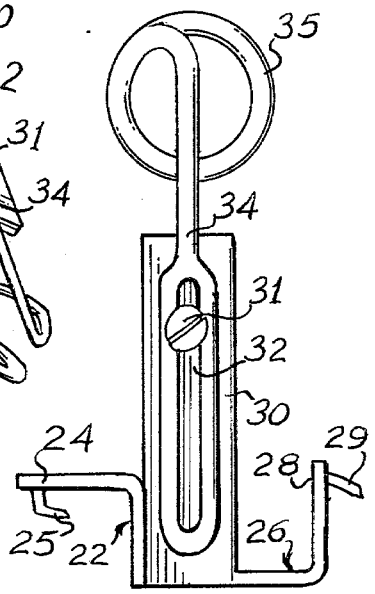
FIG. 3 is a bottom plan view of the device shown in FIG. 2 of the drawings.
Figure 4:
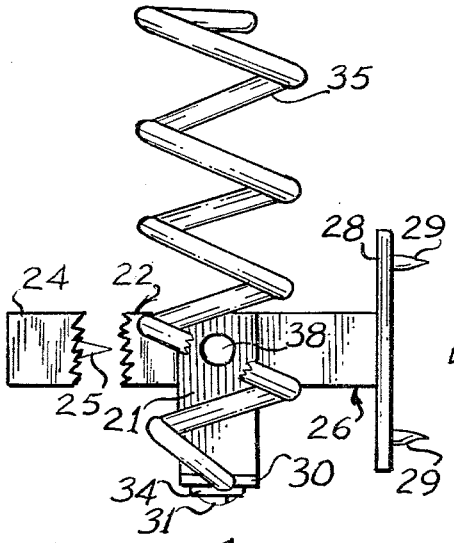
FIG. 4 is a front elevational view of the device shown in FIG. 2 of the drawings; and, FIG. 5 is a top plan view of the device shown in FIG. 2 of the drawings, and illustrating the location of the drapery and the tie back.

Looking now at FIGS. 2–4 of the drawings, it will be seen that the tie back holder 20 includes a base 21 and an arm 22 extending from the base 21 at an angle to the base 21, the arm 22 terminating in an extending end 24 which is here shown as generally parallel to the base 21. Carried by the extending end 24, there is a hook 25.

It will be seen that the hook 25 is here shown as pointed, the hook 25 constituting the attaching means for the embodiment of the invention here presented. As will be discussed in more detail hereinafter, various other forms of attaching means may be utilized equally well, but the present embodiment utilizes pins or the like so that the pin can simply be inserted into the fabric tie back 16.

There is also an arm 26 extending from the base 21 in the opposite direction from the arm 22, the arm 26 beginning in a plane substantially co-planar with the base 21 and terminating in an upwardly extending end 28. The extending end 28 carries hooks 29. Again, the hooks 29 are here shown as pointed so that the hooks, or pins, 29 can be easily inserted into the fabric tie back to act as the attaching means.

Also attached to the base 21, it will be seen that there is a stanchion 30 extending generally perpendicularly to the base 21. The stanchion 30 is here shwon as having a screw 31 threadedly received in an appropriate hole in the stanchion 30, the screw 31 slidably receiving therearound an elongated opening 32 in a pleat holding support 34. The pleat holding support 34 is therefore slidably adjustable to overlap the stanchion 30 to a great extent, or to be extended considerably beyond the stanchion 30. At its outer end, the pleat holding support 34 carries the pleat holder 35.

It will be seen in FIGS. 2 and 4 of the drawings that the pleat holder 35 is formed as a helix, the axis of the helix extending generally parallel to the base 21. It should also be noted that the pleat holder 35 is carried at one end of the pleat holding support 34, and the opposite end of the pleat holder 35 is unsupported. While the arrangement here shown has been found to be quite satisfactory, it will be obvious to those skilled in the art that the opposite end of the pleat holder 35 could be supported in the same manner if the particular installation so requires.

Figure 5:
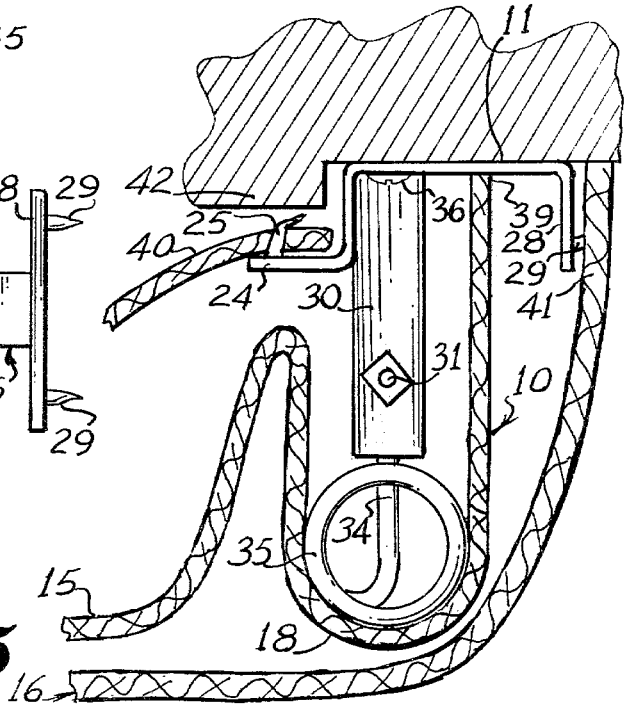

Attention is next directed primarily to FIG. 5 of the drawing for a better understanding of the use and operation of the tie back holder and the pleat holder. In FIG. 5 it will be seen that a screw 36 is shown passing through a hole 38 in the base 21, the screw 36 passing into the wall 11 for support of the device 20. It will also be seen that the entire device, including the tie back holder and the pleat holder, is mounted to the wall by the single screw 36 which passes through the hole 38 in the base 21. With the tie back holder 20 appropriately mounted against the wall 11, the drapery 10 can be put into place with the final pleat 18 extending over the pleat holder 35, and the extreme edge 39 of the drapery 10 extending between the stanchion 30 and the end 28 of the arm 26.

It will then be seen that the tie back 16 can have its first end 40 pierced by the hook 25 on the end 24 of the arm 22, the tie back then extending around the drapery 10 to gather the drapery as desired, as shown in FIG. 1 of the drawings. As the tie back 16 is brought completely around the drapery 10, the tie back 16 will extend over the pleat holder 35, then extend towards the wall 11. Using the hooks, or pins, 29 as shown in the drawings, the end 41 of the tie back 16 would be urged against the wall 11, then against the pins 29, then pulled away from the wall to cause the pins 29 to enter the fabric of the tie backs 16. With this simple motion, the end 41 of the tie back 16 is fastened, and the tie back 16 is holding the drapery 10 as desired.

From the foregoing, it will be seen that the hooks 25 and 29 act as attaching means for the ends 40 and 41 of the tie back 16. While these hooks, or pins, are simple and effective, it will be obvious that other forms of attaching means may be used. For example, a hook and teazle can be used, the hook member (for example) being fixed to the arms 22 and 26 with the teazle being fixed to the tie backs 16. Similarily, the arms 22 and 26 could be made of a ferromagnetic material, and magnets could be attached to, or sewn into, the tie backs 16. If the tie back has holes normally, as in a chain or the like, the hooks 25 and 29 need not be pointed but can be received through existing holes. Numerous other forms of attaching means will suggest themselves to those skilled in the art.

The pleat holding means 35 is here shown as helical in form, and it is contemplated that the helix will be formed of somewhat malleable wire, preferably of relatively light metal such as aluminum. Due to the configuration shown, it will be understood that the pleat holder 35 is somewhat resilient so that if someone accidently brushes against the drapery, the pleat supporting structure will not break, or bend irreparably, but may give, then return to its normal position. In the event the device is engaged by a larger force, the pleat holder 35 may bend into a position where it does not properly support the drapery plate 18; however, if the material is sufficiently malleable, the device can be easily straightened and no permanent damage will have been done.

It will of course be obvious to those skilled in the art that the pleat holder 35 may equally well be formed of molded plastic or the like. The pleat holder 35 may be molded in virtually any open-work design to be light in weight and generally cylindrical in configuration. While the open-work plastic would not have the advantages of being malleable, the light weight and other advantages of plastic would be desirable in some installations.

Another advantage of the structure generally as shown is the arrangement whereby the pleat holding support 34 is movably carried by the screw 31 so that the screw 31 can be loosened and the pleat holding support 34 can be moved as desired. Due to this arrangement, it will be understood that the pleat holder 35 can be moved towards and away from the base 21, but also can be moved angularly with respect to the stanchion 30. Thus, looking at FIG. 5 of the drawings, if the screw 36 is in place and the tie back holder 20 has been installed but the pleat 18 does not fall exactly over the pleat holder 35, the screw 31 can be loosened and the pleat holder 35 can be moved to either side to be perfectly aligned with the pleat 18.

It will further be seen in FIG. 5 of the drawings that the wall 11 is shown as having an embossed portion 42. By way of example this embossed portion 42 may comprise a window casing or the like, but it should be understood that the portion 42 may be any feature of a wall or other surface against which the drapery 10 is to be mounted. It will be seen that the shape of the arm 22 is arranged so that the extending end 24 of the arm 22 can be placed above the embossed portion 42 if desired. In the event the drapery barely covers the window and its casing, it will be seen that the tie back holder 20 of the present invention can be placed immediately beyond the casing 42 without interference from the arm 22.

From the foregoing, it should now be understood that the tie back holder 20 of the present invention provides a very simple arrangement by which a holding means for each end of the tie back can be fixed to the wall or other surface by a single fastening means such as the screw 36. The stanchion 30 could be totally omitted if desired and a very simple tie back holder would be provided; however, with the addition of the stanchion 30 the pleat holder 35 can be provided, carried by the pleat holding support 34 which is mounted from the stanchion 30. Even including the stanchion 30 the entire device is still mounted with the single fastening means. The pleat holder 35 can be formed of numerous different materials and can be made in numerous different colors to operate satisfactorily with virturally any kind of draperies. In the event the draperies are relatively thin, the pleat holder 35 can be colored similarly so that the pleat holder 35 will not be noticed, or the pleat holder 35 may be made of transparent plastic or the like.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A drapery tie back holder for a drapery having one edge adjacent to a wall and an opposite edge remote therefrom and in a plane parallel to said wall, a tie back extending generally from said one edge around said drapery and back to said one edge, said tie back holder including a base defining means for fixing said base to said wall, a first arm extending from said base generally towards said opposite edge for holding a first end of said tie back, and a second arm extending from said base generally perpendicularly to said wall for holding a second end of said tie back, said drapery defining a plurality of pleats therein, including a final pleat adjacent to said one edge of said drapery, said tie back holder including a pleat holding means supported from said base between said first arm and said second arm for supporting said final pleat.

2. A drapery tie back holder as claimed in claim 1, said pleat holding means having an axis generally parallel to said one edge of said drapery and alignable with said final pleat.

3. A drapery tie back holder as claimed in claim 2, and including a stanchion fixed to said base and extending generally perpendicularly to said wall, said pleat holding means having a pleat holder support adjustably carried by said stanchion and fixed to one end of said pleat holding means.

4. A drapery tie back holder as claimed in claim 3, said pleat holding means having a generally cylindrical configuration, said pleat holder support being fixed to at least one end of the cylinder.

5. A drapery tie back holder as claimed in claim 4, said pleat holding means being helical and formed of a malleable material.

6. A drapery tie back holder as claimed in claim 5, said means for fixing said base to said wall comprising a single screw receivable through an opening defined in said base.

7. A drapery tie back holder as claimed in claim 5, said pleat holding means and said pleat holder support being formed integrally of malleable wire, and releasible securing means for selectively fixing said pleat holder support to said stanchion.

* * * * *